US007721770B2

(12) United States Patent
Fischer et al.

(10) Patent No.: US 7,721,770 B2
(45) Date of Patent: May 25, 2010

(54) METHOD OF OPERATING A DEVICE FOR FILLING A TANK WITH CRYOGENICALLY STORED FUEL

(75) Inventors: Gregor Fischer, Ismaning (DE); Robert Barnsteiner, Munich (DE); Johann Schnagl, Neuried (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/348,149

(22) Filed: Jan. 2, 2009

(65) Prior Publication Data

US 2009/0107152 A1 Apr. 30, 2009

Related U.S. Application Data

(63) Continuation of application No. PCT/EP2007/056363, filed on Jun. 26, 2007.

(30) Foreign Application Priority Data

Jul. 5, 2006 (DE) ..... 10 2006 031 000

(51) Int. Cl.
*B65B 31/00* (2006.01)
*F17C 9/02* (2006.01)

(52) U.S. Cl. ..... 141/7; 141/4; 141/5; 141/11; 141/59; 141/82; 62/50.2

(58) Field of Classification Search ..... 141/4–7, 141/11, 59, 69, 82, 286; 62/50.1, 50.2
See application file for complete search history.

(56) References Cited

U.S. PATENT DOCUMENTS 4,608,830 A 9/1986 Peschka et al.

(Continued)

FOREIGN PATENT DOCUMENTS

DE 33 44 770 A1 6/1985

(Continued)

OTHER PUBLICATIONS

German Search Report dated May 14, 2007 with English translation (Nine (9) pages).

(Continued)

*Primary Examiner*—Timothy L Maust
(74) *Attorney, Agent, or Firm*—Crowell & Moring LLP

(57) ABSTRACT

A method for operating a device for filling a tank for storing fuel as condensed gas for a consumer that can be operated with cryogenically stored fuel. Included is at least one filling line and one extraction line for connecting to a filling device on a gas-station-side. In a first time period for cooling the tank, the condensed gas is introduced into the tank, at least the large part is extracted again in the form of gas via the extraction line, and in a second subsequent time period, the tank is filled with condensed gas at the same time as at least the displaced gas is extracted. In a subsequent third time period, the filling line is closed and the extraction line is maintained open in order to guide the gas from the tank back until the pressure and/or the temperature in the tank is/are lowered to defined values.

18 Claims, 4 Drawing Sheets

U.S. PATENT DOCUMENTS

| | | | | |
|---|---|---|---|---|
| 5,040,577 | A | 8/1991 | Pope | |
| 5,353,849 | A | 10/1994 | Sutton et al. | |
| 5,365,981 | A | 11/1994 | Peschka et al. | |
| 5,385,178 | A * | 1/1995 | Bedi | 141/59 |
| 5,597,020 | A | 1/1997 | Miller et al. | |
| 5,699,839 | A * | 12/1997 | Dehne | 141/248 |
| 6,142,191 | A * | 11/2000 | Sutton et al. | 141/59 |
| 6,196,280 | B1 * | 3/2001 | Tate et al. | 141/302 |
| 6,354,088 | B1 * | 3/2002 | Emmer et al. | 62/50.1 |
| 6,755,219 | B1 * | 6/2004 | Bolle | 141/9 |
| 7,021,341 | B2 * | 4/2006 | Viegas et al. | 141/82 |
| 2005/0183425 | A1 | 8/2005 | Immel | |

FOREIGN PATENT DOCUMENTS

| | | | |
|---|---|---|---|
| DE | 41 04 766 | C2 | 8/1992 |
| DE | 41 29 020 | C2 | 3/1993 |
| DE | 195 07 526 | A1 | 9/1996 |
| DE | 203 11 991 | U1 | 11/2003 |
| DE | 10 2004 056 186 | A1 | 5/2006 |
| WO | WO 02/064395 | A2 | 8/2002 |

OTHER PUBLICATIONS

International Search Report dated Nov. 14, 2007 with English translation (Six (6) pages).

* cited by examiner

METHOD OF OPERATING A DEVICE FOR FILLING A TANK WITH CRYOGENICALLY STORED FUEL

CROSS REFERENCE TO RELATED APPLICATIONS

This application is a continuation of PCT International Application No. PCT/EP2007/056363, filed Jun. 26, 2007, which claims priority under 35 U.S.C. §119 to German Patent Application No. DE 10 2006 031 000.4, filed Jul. 5, 2006, the entire disclosures of which are herein expressly incorporated by reference.

BACKGROUND AND SUMMARY OF THE INVENTION

The invention relates to a method of operating a device for filling a tank with cryogenically stored fuel, particularly for supplying an internal-combustion engine driving a motor vehicle. With respect to the technical background, reference is made to German patent document DE 10 2004 056 186 A1.

Fuels for driving motor vehicles, such as hydrogen, natural gas or the like, can be stored virtually only in a liquefied form and thus in a highly cooled condition in order to obtain the demanded volumetric and gravimetric storage densities. The intensely cooled liquid hydrogen supply is stored in the vehicle in the boiling or almost boiling condition in a thermally well insulated, pressure-tight tank. The physical density of the boiling hydrogen is maximized by storage at a temperature slightly above the boiling temperature at an ambient pressure, approximately 20 K.

In today's technically implemented storage tanks, hydrogen is typically present at temperatures of approximately 21 K to approximately 27 K, and the corresponding boiling pressures of approximately 2 bar (abs.) to approximately 5 bar (abs.). In the lower part of the storage tank, the boiling hydrogen is present as a denser liquid phase (LH2) and, situated above the latter, as a gaseous phase (GH2). A gaseous as well as a liquid removal of the hydrogen from the storage tank is contemplated and meaningful. As a result of the removal of hydrogen during the operation of the storage device when supplying the internal-combustion engine after a pressure build-up phase, the storage pressure is reduced until the storage tank operating pressure is reached without any targeted heat feed. Because the enthalpy removal is lower when liquid is removed and because of the resulting slower pressure reduction, a removal from the gaseous phase (gas removal) is therefore meaningful.

However, in the case of this cryogenic fuel storage, as a result of the feeding of heat into the fuel tank, a small amount of liquid fuel evaporates continuously. The pressure in the fuel tank therefore increases until the limit value set for the latter—also called the "boil-off" pressure—is reached, and the further evaporating fuel has to be blown off from the fuel tank as so-called boil-off gas. Particularly when no consuming device for the fuel is operative, i.e., particularly when the internal-combustion engine is inoperative, the internal pressure of the tank will rise as a result of the feeding of heat without any removal. For reasons of safety, this pressure has to be limited by the opening of valves. In this case, the boil-off gas is generally released into the environment by way of blow-off pipes in which the above-mentioned valves are provided. The selection of the operating pressure in the fuel tank and of the pressure stroke between the operating pressure and the boil-off pressure, in addition to the amount of the heat feeding, considerably determine the loss-free pressure build-up time.

When fueling a tank for cryogenic liquids whose temperature is above the operating temperature, the excess thermal energy should advantageously be discharged together with the return gas. As a time window, the fueling time is available for this purpose. Heat that cannot be dissipated during fueling is absorbed by the hydrogen and, when the vehicle is not operated by means of hydrogen, results in a pressure rise in the tank.

FIG. 1 shows the state of the art when filling a tank with cryogenically stored fuel at a gas station, in the case of a warm fueling. The warm tank is filled by the gas station by way of liquid hydrogen and is cooled in the process in that the entire fed hydrogen mass is returned to the gas station as heated gaseous hydrogen.

When the tank has reached the required temperature, i.e., LH2 is assumed, the liquid level will rise in the tank. Furthermore, a residual quantity of heated gas is discharged to the gas station. At the end of the fueling, the liquid level in the tank has reached 100%; the fueling is terminated and all tank valves are closed.

At this point in time, however, the tank is not completely cooled throughout. Residual heat is absorbed by the hydrogen; the latter heats up and expands and the pressure in the tank increases as a result. The pressure rise may be so large that no sufficient amounts of gas can be removed even by the response of the boil-off valve and, because of the further pressure rise, an undesirable opening of the safety valve takes place.

Depending on the warm fueling duration and the filling level at the end of the fueling, hydrogen is released into the environment, specifically up to 900 g/h or up to 1 kg/warm fueling. As a result, the emission limit in the operational case (5 g/day), as in the case of a disturbance (60 g/h), is considerably exceeded, and garage parking cannot take place after a warm fueling.

It is therefore an object of the invention to provide a method for operating a device for filling a tank with cryogenically stored fuel which makes it possible to carry out a warm fueling that keeps the pressure rise in the tank so low that no hydrogen has to be blown off by way of the safety valve, thereby increasing the service life of the cryotank.

According to the invention, a method is provided for operating a device for filling a tank for storing fuel as condensed gas, in particular a cryotank, for a consuming device that can be operated with cryogenically stored fuel, in particular an internal-combustion engine of a motor vehicle. The tank includes a filling device for the cryogenically stored fuel. The filling device includes at least one filling line and one removal line, for connecting with a gas-station-side filling device. In this case, the filling operation is controlled such that, in a first time period, for cooling the tank, condensed gas is introduced by way of the filling line into the latter which, for the most part, is removed again as gas by way of the removal line, and that, in a second, subsequent time period, the tank is filled with condensed gas, while removing at least the gas displaced thereby. In a subsequent, third time period, the filling line is closed and the removal line is kept open in order to return gas from the tank to the gas station until the pressure and/or the temperature in the tank have fallen to predetermined values.

As a result, it becomes possible to significantly shorten the fueling time for a warm fueling. Specifically, the warm fueling duration is a function of the actual quantity of heat still present in the system. In this case, the actual tank temperature is taken into consideration. The lowering of the pressure during the third time period—the conditioning—leads to a reduction of the gas quantity to be discharged because the evaporation enthalpy rises considerably at lower pressures. However, in the boiling condition, lower pressure also results in a lower temperature.

This has the result that the temperature difference with respect to the still warm components is greater and the heat is therefore dissipated faster to the hydrogen, which shortens the fueling time.

In addition, the pressure rise in the tank is kept so low that no hydrogen has to be blown-off by way of the safety valve. The service life of the cryotank is thereby increased.

An advantageous embodiment of the process is characterized in that the third time period is followed by a fourth time period, in which the filling line is opened and closed again.

When the pressure or the temperature in the tank have fallen to the required extent, the "fueling" signal is switched away from the vehicle, and the liquid fueling valve is opened for a short time. This has the advantage that the function routine "end of fueling" can thereby easily be triggered on the part of the gas station. Subsequently, the fueling coupling can be released in order to be detached.

Another advantageous embodiment of the method is characterized in that a control device present on the gas station side, particularly a two-position controller or a proportional control element, in the third time period, keeps the pressure in the tank above the ambient pressure but below the tank operating pressure.

In the third time period, in which the conditioning takes place, the gas quantity decreases with the lowering heat feed and thus the pressure in the tank also decreases. Advantageously, a conclusion can be drawn from the occurring pressure with respect to the remaining residual heat quantity in the tank. When the residual heat quantity is reduced to an amount which, in the event of absorption by the hydrogen, will not lead to an excessive rise of the tank pressure and thereby an opening of the safety blow-off valve, the conditioning operation can be concluded by closing the removal valve. This relates to a control device with a proportional control element.

By using a two-position controller as a control element, the pressure in the tank is kept low during the conditioning. The pressure band is situated below the normal operating pressure of the tank, but above the ambient pressure. When the shut-off element of the two-position controller of the gas station is closed, the tank pressure will rise. As the heat feed by the tank falls, the rate of the pressure rise in the tank will also decrease. By analyzing these measured values, a conclusion can be drawn as to the residual amount of heat still present in the system. When the residual amount of heat is reduced to an amount which, when absorbed by the hydrogen, will not lead to an excessive rise of the tank pressure and thereby an opening of the safety blow-off valve, the removal valve can be closed and the conditioning can thereby be terminated.

Thus, in the third time period, the still present amount of heat in the tank system can advantageously be determined by way of the rate of the pressure rise or the existing momentary pressure in the tank, in which case, the removal line is, at the earliest, closed when a subsequent pressure increase, caused by the still present amount of heat in the tank system and by the closed removal line, will remain below the pressure limit value which is provided for the opening of a tank safety blow-off valve.

Further preferred embodiments of the process are characterized in that the fueling operation is terminated at the earliest after the expiration of the third time period by the one-sided or mutual release of fueling elements on the vehicle-side and the gas station-side. A control device, particularly on the gas station-side, is advantageously provided for the described control operations, which control device processes predefined and measured values corresponding to the method steps.

Other objects, advantages and novel features of the present invention will become apparent from the following detailed description of one or more preferred embodiments when considered in conjunction with the accompanying drawings.

BRIEF DESCRIPTION OF THE DRAWINGS

Three preferred embodiments of the process according to the invention will be shown in detail in the following description and the pertaining drawings.

DETAILED DESCRIPTION OF THE DRAWINGS

Figure 1:
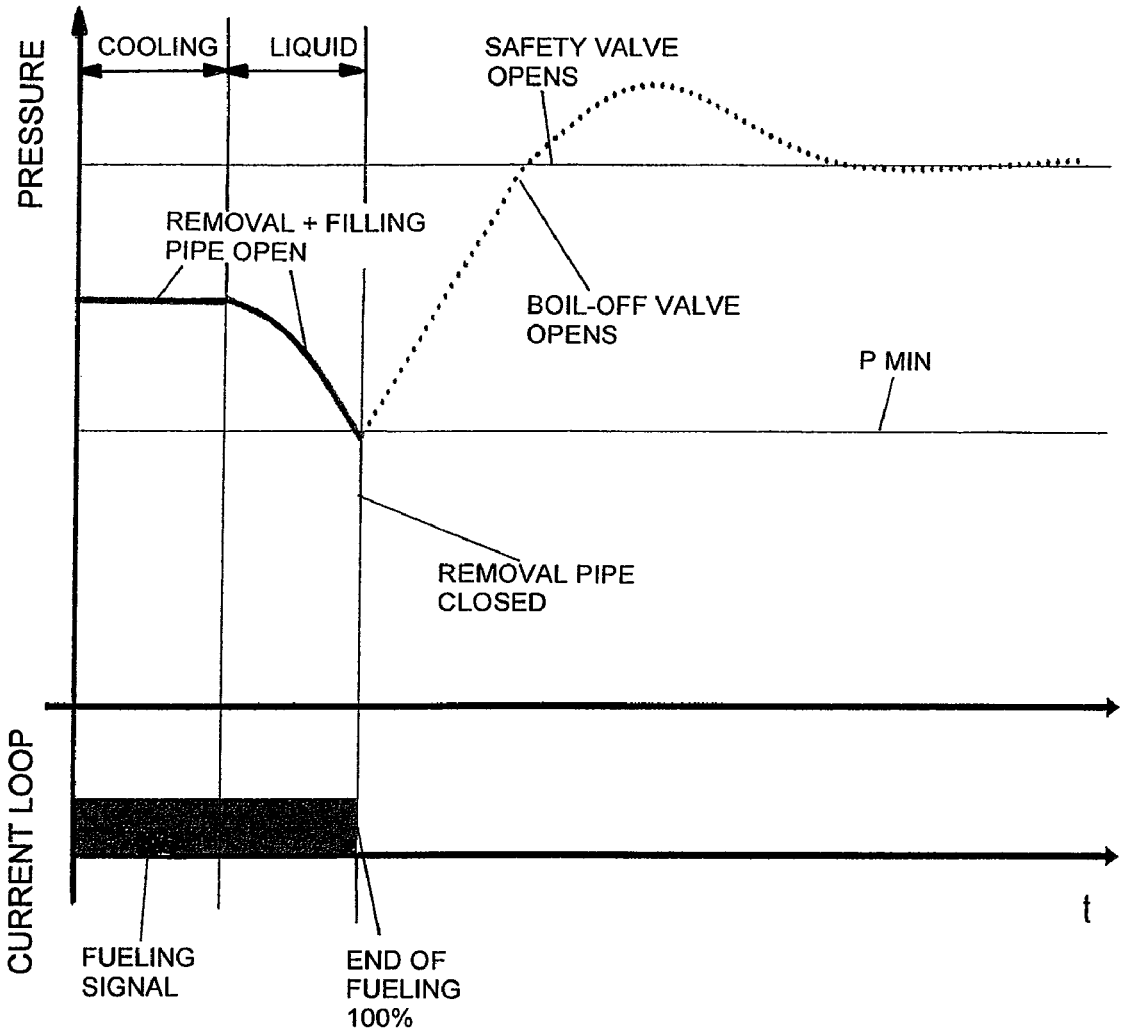
FIG. 1 is a pressure distribution-time diagram for the filling of a tank with cryogenically stored fuel in two time periods according to the state of the art.

FIG. 1 illustrates the state of the art when filling a tank with cryogenically stored fuel at a gas station in the case of a warm fueling. The warm tank is filled by the gas station using liquid hydrogen and is cooled in the process, in that the entire fed hydrogen mass is released again to the gas station as warmed-up gaseous hydrogen. The filling line (F-Bev) and the removal line (G-Bev) are open during the first time period (cooling). The fueling signal is emitted at the gas station until the end of the fueling, at the end of the second time period (liquid), while the filling line (F-Bev) and the removal line (G-Bev) are also open and the tank has reached the necessary temperature for accepting liquid hydrogen, LH2. As a result, the liquid level rises in the tank. A residual amount of warmed-up gas continues to be discharged to the gas station by way of the removal line (G-Bev). At the end of the fueling, the liquid level in the tank has reached 100%; the fueling is concluded; and the filling line (F-Bev) and the removal line (G-Bev) are closed by way of the tank valves.

However, at this point in time, the tank is not completely cooled throughout. Residual heat is absorbed by the hydrogen; the latter is warmed up and expands, causing the pressure in the tank to rise. The pressure rise, indicated by a dotted line, may be so high that no sufficient amounts of gas can be discharged even by the response of the boil-off valve (BOV open), and, because of a further pressure rise, an undesirable opening of the safety blow-off valve (SV open) takes place.

Figure 2:
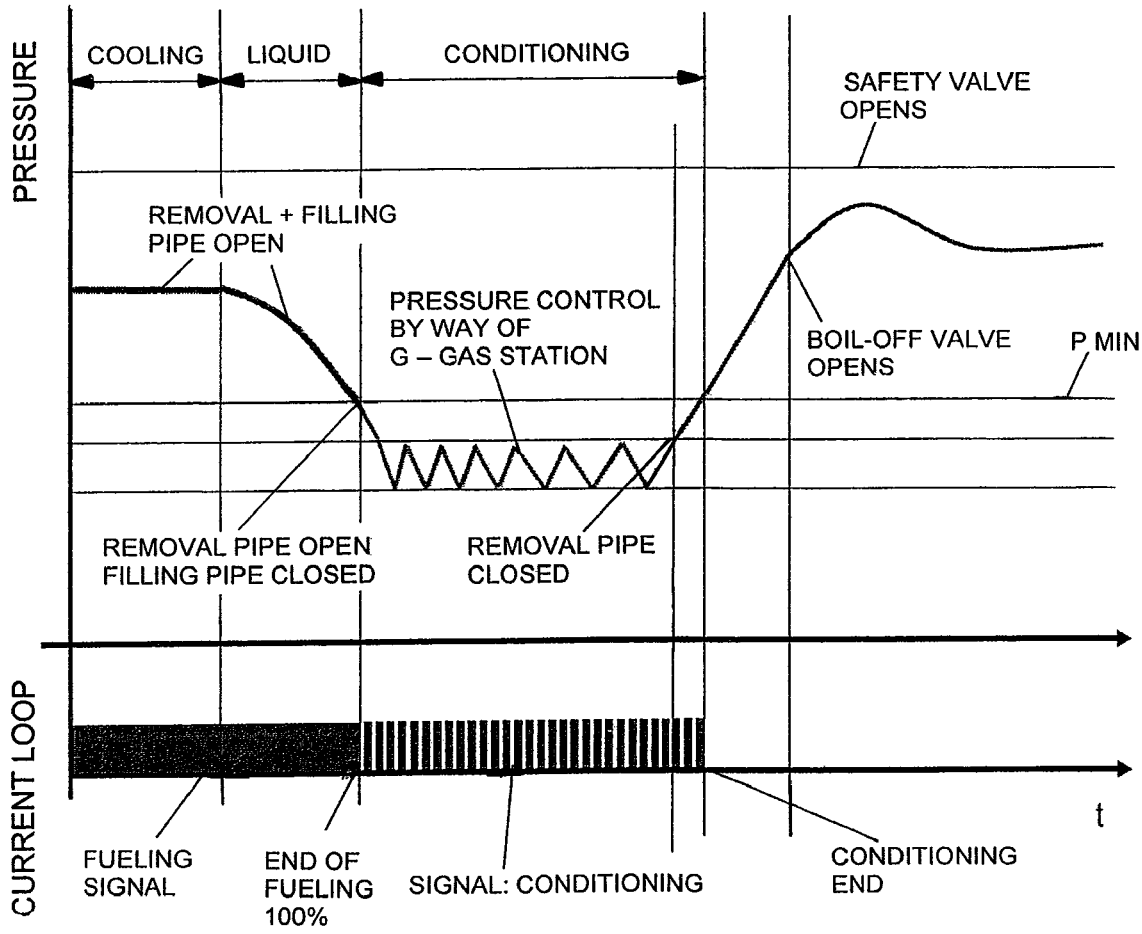
FIG. 2 is a pressure distribution-time diagram for the filling of a tank with cryogenically stored fuel in three time periods according to the method of the invention with a two-position controller.

FIG. 2 shows the method according to the invention, which avoids the above-mentioned disadvantage, in a pressure distribution-time diagram for filling a tank with cryogenic fuel in three time periods, by using a two-position controller. The first two time periods (cooling, liquid) correspond to those described in FIG. 1 with respect to the state of the art. They will not be explained here again. However, at the end of the second time period (liquid), the removal line (G-Bev) remains open and only the filling line (L-Bev) is closed.

A third time period (conditioning) with a closed filling line (L-Bev) and an open removal line (G-Bev), which follows the first and second time periods (cooling, liquid) is provided for returning gas from the tank to the gas station until the pressure and/or the temperature in the tank have fallen to predefined values. In this case, the conditioning signal is emitted on the gas station side. In the third time period (conditioning), the control device—a two-position controller—present on the gas station side keeps the pressure in the tank above the ambient pressure but below the tank operating pressure. The still existing amount of heat in the tank system is determined by way of the rate of the pressure rising in the tank. The removal line (G-Bev) is closed at the earliest when a subsequent pressure increase caused by the still present quantity of heat in the tank system and by the closed removal line (G-Bev) remains below the pressure limit value (SV open), which is provided for the opening of a tank safety blow-off valve. For this purpose, a gas-station-side control device processes predefined values and measured values during the method steps and terminates the fueling operation at the earliest after the expiration of the third time period (conditioning) by the one-sided release of the gas-station-side fueling element. As a result of the transfer of the residual heat of the tank to the hydrogen, the boil-off valve will therefore now only still be opened after a certain time of non-use of the motor vehicle and gaseous hydrogen will be blown-off (BOV open).

Figure 3:
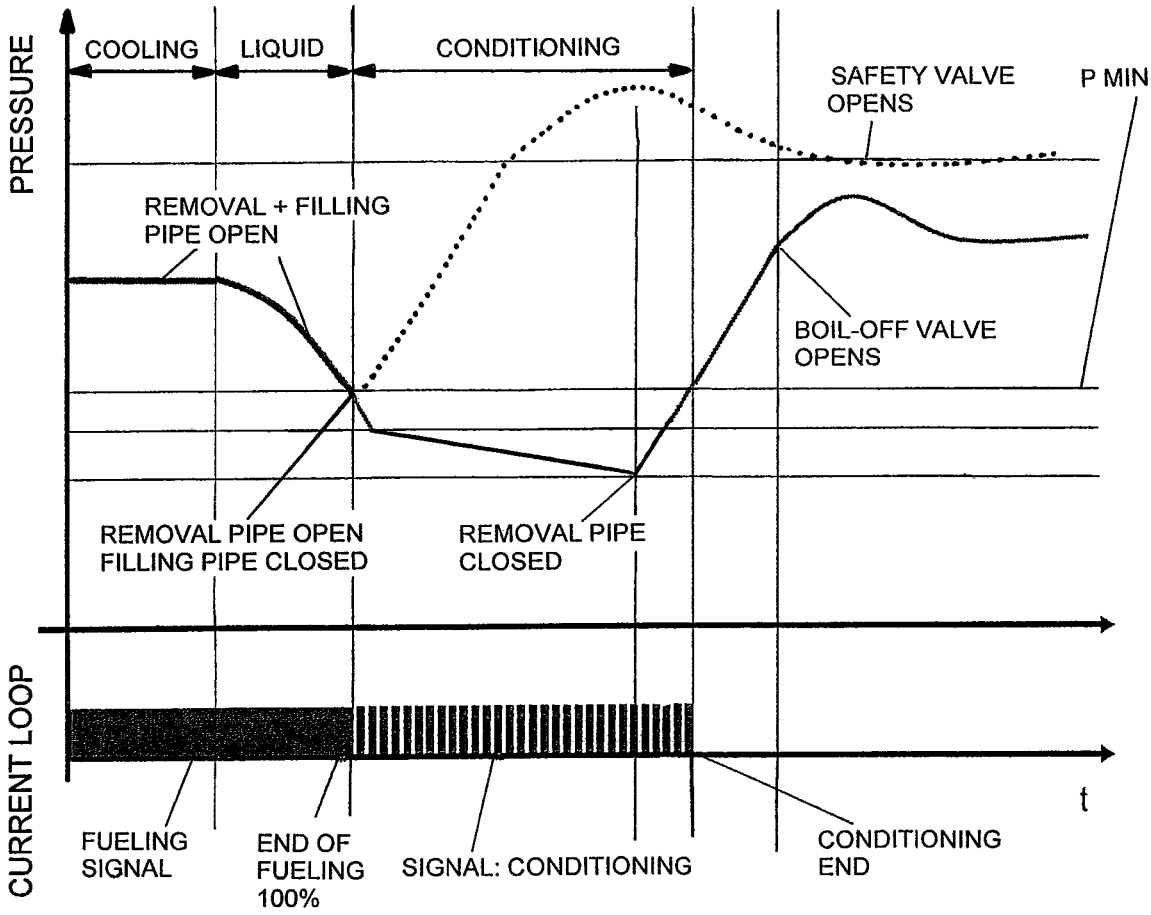
FIG. 3 is a pressure distribution-time diagram for the filling of a tank with cryogenically stored fuel in three time periods according to the method of the invention with a proportional control element.

In contrast to FIG. 2, FIG. 3 illustrates a pressure distribution-time diagram for filling a tank with cryogenically stored fuel according to the invention with a proportional control element. Any method steps and characteristics not explained here correspond to those of FIG. 2.

In this method, the control device present on the gas-station-side is a proportional control element which, in the third time period (conditioning), keeps the pressure in the tank above the ambient pressure but below the tank operating pressure. The still existing amount of heat in the tank system is therefore determined by the control device by way of the existing momentary pressure in the tank. In addition, this figure also shows the course of the pressure in the tank over the time taken over from FIG. 1 by means of a dotted line, which is insignificant for the described process, only for the purpose of a comparison and for illustrating the comparison.

Figure 4:
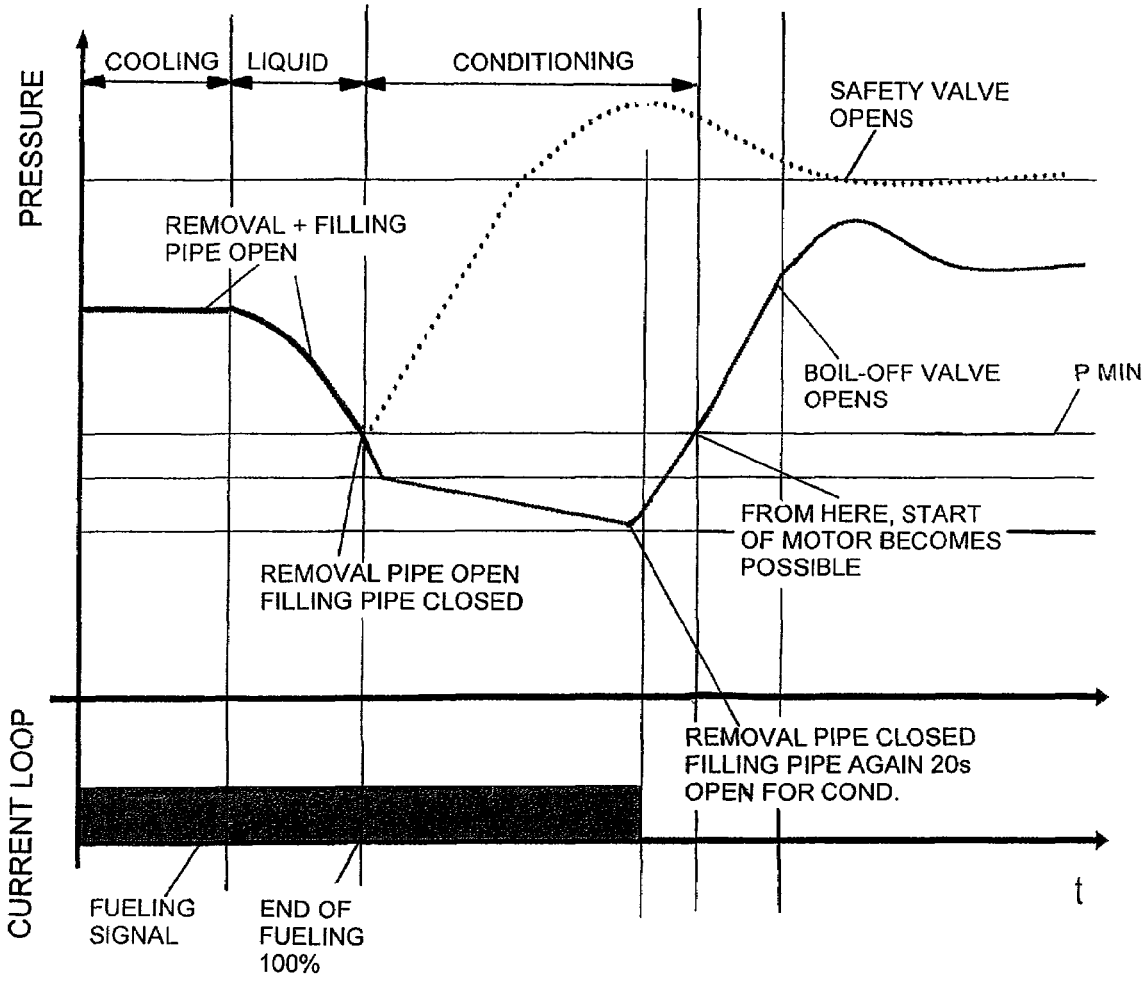
FIG. 4 is a pressure distribution-time diagram for the filling of a tank with cryogenically stored fuel in three time periods according to the method of the invention without a control element on the gas station-side.

In contrast to FIG. 3, FIG. 4 illustrates a pressure distribution-time diagram for filling a tank with cryogenically stored fuel according to the method of the invention without a gas-station-side control element. Any process steps and characteristics not explained here correspond to those of FIGS. 2 and 3.

The end of the third time period (conditioning) is followed by a fourth time period (conditioning), in which the filling line (L-Bev) is again opened and then closed again. In this case, the filling line (L-Bev) is kept open for approximately 20 seconds, while the removal line (G-Bev) is already closed. Thus, without a control element, when the pressure or the temperature in the tank have fallen to a required extent and the fueling signal has been switched away from the vehicle, the function routine "end of fueling" can be triggered in a simple manner by opening the filling line (L-Bev) on the side of the gas station. Subsequently, the fueling coupling can be released for detachment.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of operating a device for filling a tank for storing fuel as condensed gas for use by a consuming device operable with cryogenically stored fuel, the tank having a filling device for the cryogenically stored fuel, at least comprising a filling line and a removal line for connecting to a station-side filling device, the method comprising the acts of:

in a first time period, for cooling the tank, introducing condensed gas via the filling line into the tank, said condensed gas being, at least in large part, removed again in gas form via the removal line;

in a second, subsequent, time period, filling the tank with condensed gas at the same time as at least displaced gas is removed; and in a third, subsequent, time period, closing the filling line and keeping the removal line open in order to return gas from the tank to the station-side until a pressure and/or a temperature in the tank is lowered to predetermined values.

2. The method according to claim 1, wherein the third time period is followed by a fourth time period in which the filling line is again opened and then again closed.

3. The method according to claim 1, wherein, in the third time period, the pressure in the tank is maintained above an ambient pressure but below a tank operating pressure using one of a two-position controller and a proportional control element present on the station-side.

4. The method according to claim 2, wherein, in the third time period, the pressure in the tank is maintained above an ambient pressure but below a tank operating pressure using one of a two-position controller and a proportional control element present on the station-side.

5. The method according to claim 1, further comprising the act of:

in the third time period, determining a still existing heat quantity in the tank by way of either a rate of pressure increase or an existing momentary pressure in the tank.

6. The method according to claim 2, further comprising the act of:

in the third time period, determining a still existing heat quantity in the tank by way of either a rate of pressure increase or an existing momentary pressure in the tank.

7. The method according to claim 3, further comprising the act of:

in the third time period, determining a still existing heat quantity in the tank by way of either a rate of pressure increase or an existing momentary pressure in the tank.

8. The method according to claim 1, wherein, in the third time period, the removal line is closed no sooner than when a subsequent pressure increase caused by a still existing heat quantity in the tank and by the removal line being closed remains below a pressure limit value, which pressure limit value is provided for opening a tank safety blow-off valve.

9. The method according to claim 2, wherein, in the third time period, the removal line is closed no sooner than when a subsequent pressure increase caused by a still existing heat quantity in the tank and by the removal line being closed remains below a pressure limit value, which pressure limit value is provided for opening a tank safety blow-off valve.

10. The method according to claim 3, wherein, in the third time period, the removal line is closed no sooner than when a subsequent pressure increase caused by a still existing heat quantity in the tank and by the removal line being closed remains below a pressure limit value, which pressure limit value is provided for opening a tank safety blow-off valve.

11. The method according to claim 5, wherein, in the third time period, the removal line is closed no sooner than when a subsequent pressure increase caused by a still existing heat quantity in the tank and by the removal line being closed remains below a pressure limit value, which pressure limit value is provided for opening a tank safety blow-off valve.

12. The method according to claim 1, wherein the fueling operation is concluded no sooner than after an expiration of the third time period by a one-sided, or mutual, release of vehicle-side and station-side fueling elements.

13. The method according to claim 2, wherein the fueling operation is concluded no sooner than after an expiration of the third time period by a one-sided, or mutual, release of vehicle-side and station-side fueling elements.

14. The method according to claim 3, wherein the fueling operation is concluded no sooner than after an expiration of the third time period by a one-sided, or mutual, release of vehicle-side and station-side fueling elements.

15. The method according to claim 8, wherein the fueling operation is concluded no sooner than after an expiration of the third time period by a one-sided, or mutual, release of vehicle-side and station-side fueling elements.

16. The method according to claim 1, wherein a control device operatively configured on the station-side processes defined and measured values in accordance with the method.

17. The method according to claim 1, wherein the tank is a cryotank and the consuming device is an internal combustion engine.

18. The method according to claim 17, wherein the internal combustion engine is arranged in a motor vehicle.

* * * * *